United States Patent [19]

Kuroda et al.

[11] 4,422,623

[45] Dec. 27, 1983

[54] APPARATUS FOR COOLING STEEL STRIPS TO EFFECT CONTINUOUS ANNEALING

[75] Inventors: Hiroshi Kuroda, Tokyo; Yoshikazu Fukuoka, Fukuyama; Hiroshi Naemura, Fukuyama; Takayoshi Shihomura, Fukuyama, all of Japan

[73] Assignee: Nippon Kokan Kabushiki Kaisha, Tokyo, Japan

[21] Appl. No.: 382,205

[22] Filed: May 26, 1982

Related U.S. Application Data

[63] Continuation of Ser. No. 160,077, Jun. 16, 1980, abandoned.

[30] Foreign Application Priority Data

Jun. 28, 1979 [JP] Japan ..... 54-80808

[51] Int. Cl.[3] ..... C21D 9/573

[52] U.S. Cl. ..... 266/109; 266/112; 148/156

[58] Field of Search ..... 266/109, 111–113; 148/156

[56] References Cited

U.S. PATENT DOCUMENTS

| | | | |
|---|---|---|---|
| 1,268,155 | 6/1918 | Rowland | 266/109 |
| 2,189,836 | 2/1940 | Schon | 148/13.1 |
| 2,890,037 | 6/1959 | Rendel | 266/109 |
| 3,682,712 | 8/1972 | Vernier | 148/156 |
| 4,296,919 | 10/1981 | Sakurai | 266/111 |

FOREIGN PATENT DOCUMENTS

| | | | |
|---|---|---|---|
| 5610973 | 7/1975 | Japan | 266/109 |

*Primary Examiner*—L. Dewayne Rutledge
*Assistant Examiner*—Christopher W. Brody
*Attorney, Agent, or Firm*—Frishauf, Holtz, Goodman and Woodward

[57] ABSTRACT

A steel strip heated to a temperature above a recrystallization temperature is passed through a cooling unit including a plurality of cooling rollers cooled by cooling water flowing through the interior thereof. The steel strip is caused to pass alternately about upper and lower surfaces of the cooling rollers. By raising and lowering alternate cooling rollers, the contact angle and therefore the contact area, i.e., the contact time between the strip and the cooling rollers is varied to change the cooling rate. When the cooling rollers are separated from the strip. Cooling water is filled into the cooling unit to directly cool the strip. Cooling gas may be ejected against the strip before it enters into the cooling unit.

8 Claims, 8 Drawing Figures

APPARATUS FOR COOLING STEEL STRIPS TO EFFECT CONTINUOUS ANNEALING

This is a continuation of application Ser. No. 160,077 filed June 16, 1980, now abandoned.

BACKGROUND OF THE INVENTION

Apparatus for cooling steel strips (this term includes plates too) to effect continuous annealing thereof are classified into two types, one so-called gas jet type and the other water cool type. Although each type has an inherent advantage, it accompanies certain defects.

More particularly, according to the gas jet system cooling gas is blasted at a high speed against a steel strip heated to a temperature of about $A_1$ transition point to cool the strip to about 400° C. and then the strip is subjected to a super aging treatment for 3 to 5 minutes. The cooling efficiency of gas is inferior than that of liquid because of its small thermal capacity. Although liquid has a larger thermal capacity than gas, vapour film formed on the surface of the strip decreases the cooling efficiency. For this reason, in a modern high speed large processing line, the cooling equipment is large, expensives and requires a high running cost.

However, the gas jet type has an advantage that its cooling speed can be adjusted at will which is suitable for soft steel strip, and the heat cycle of this type is economical because in contrast to the water cooling type it is not necessary to first cool the coolant to room temperature and then heat it to a super aging temperature.

Among the water cooling types, i.e., water quenching systems are included a method in which a liquid coolant is ejected upon a uniformly heated steel strip and a method in which a heated steel strip is dipped in a liquid coolant. To eject liquid, not only is special ejection equipment necessary but also the pattern of the ejected cooling liquid varies, thus failing to obtain uniform cooling and homogeneous product.

The heat cycle of each cooling system is fast. Especially, with the dip method since the cooling speed is especially high, i.e., of the order of 1000°-2000° C./sec., which should be compared with 10°-30° C./sec. of the gas jet method, the dip method is suitable for manufacturing high tension steel stocks having a mixed structure of ferrite and martensite and not containing any other special elements. As above pointed out since this method ensures a high speed cooling, the cooling equipment for a high speed steel strip processing line is extremely compact. Moreover, as it is sufficient to merely pass the steel strip through cooling water the running cost can be greatly reduced.

In spite of the advantages described above since the cooling speed is too rapid, even when the cooling water is heated to the boiling point thereof, it is impossible to transfer to the super aging temperature during cooling and since the steel strip subjected to cooling becomes about 100° C. or normal temperature, where super aging treatment is performed subsequent to quenching it is necessary to reheat the steel strip which has been cooled to such a low temperature which requires additional process steps and equipment resulting in a poor thermal efficiency.

SUMMARY OF THE INVENTION

It is an object of this invention to provide an improved method and apparatus for cooling a continuously running steel strip capable of readily adjusting the cooling rate of a steel strip.

Another object of this is to provide a method and apparatus for cooling at any cooling rate a steel strip which has been heated to a recrystallization temperature without forming oxide films.

Still another object of this invention is to provide an improved cooling unit in which the strip can be cooled indirectly by passing about a series of cooling rollers through which cooling water is passed or directly by passing through a body of cooling water.

According to this invention there is provided a cooling apparatus for continuously annealing a steel strip which has been heated to a temperature above a recrystallization temperature, characterized by comprising a cooling unit including a plurality of cooling rollers about which the steel strip is passed, and a mechanism for varying the contact area between the steel strip and the cooling rollers, thus varying contact time between the steel strip and the cooling rollers, the interior of the cooling rollers being passed with cooling medium.

A gas cooling unit which ejects cooling gas against the steel strip may be provided in front of the water cooling unit. The steel strip is passed about alternate upper and lower surfaces of the cooling rollers. When alternate cooling rollers are raised to away from the strip, the cooling unit is filled with water thus effecting direct cooling of the steel strip. A water tank is connected to the cooling unit via a water seal and the cooling unit is circulated through the cooling unit and the water tank. In this manner when water is drained from the cooling unit and the water tank, the alternate rollers are lowered to cause the steel strip to pass through a wavy passage while contacting the upper and lower surfaces of the cooling rollers. In this case, cooling water is passed through the interior of the cooling rollers, thus effecting indirect cooling. In this manner, the cooling unit of this invention can readily switched between direct cooling and indirect cooling.

DESCRIPTION OF THE PREFERRED EMBODIMENTS

Figure 1:
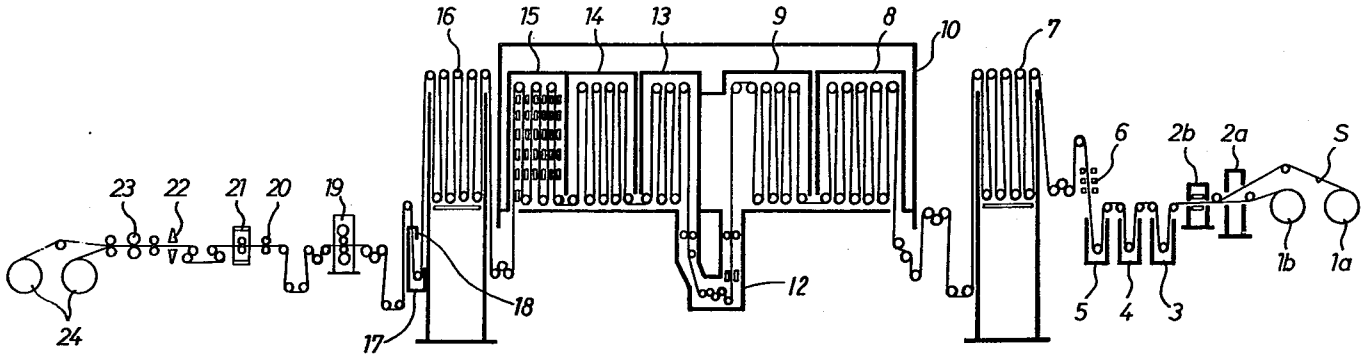
FIG. 1 is a diagrammatic representation showing one example of a continuous annealing apparatus embodying the invention.

In a continuous annealing apparatus shown in FIG. 1, a steel strip (S) payed out from either one of a plurality of uncoilers 1*a* and 1*b* is continuously passed through a processing line by alternately connecting together the strips payed out from respective uncoilers with a shear 2a and a welder 2b. Following the welder 2b are installed in succession, an alkali washing tank 3, an electrolysis rinsing tank 4 and a hot water spray washing tank 5 which comprise a pretreatment surface cleaning unit. After passing through this pretreatment surface cleaning unit the strip is then guided into a furnace 10 via a dryer 6 and an inlet looper 7. The furnace 10 includes a heating zone 8 for effecting recrystallization annealing, a uniform heating zone 9 and a cooling unit 12. The strip recrystallized, annealed and cooled in this manner is then introduced into the furnace 10 again and passed through a reheating zone 13 for over aging proceeding, an over aging proceeding zone 14 and a gas cooling zone 15. The strip is then passed through an outlet looper 16, a water cooling unit 17, a dryer 18 and a refining mill 19. After passing through the refining mill 19, the strip (S) passes through a trimming width varying notcher 20, a side trimmer 21, an oiler 22, an exit shear 23 and is finally taken up by a take up reel 24.

Figure 2:
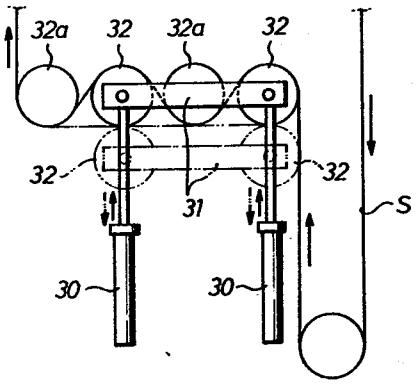
FIG. 2 is a side view of the cooling rollers shown in FIG. 1.
Figure 3:
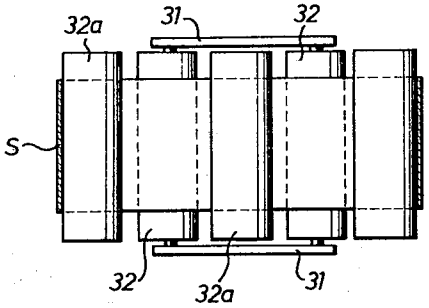
FIG. 3 is a plan view of the cooling rollers shown in FIG. 2.

The cooling unit utilized in the annealing apparatus is shown in FIGS. 2 and 3. More particularly, the strip (S) passes about four rollers 32 and 32a. A pair of rollers 32 can be raised or lowered together with their supporter 31 by means of screw or oil pressure cyliner 30. Water or other cooling passes through the interior of either one or both of the rollers 32 and 32a. By varying the contact angle or length of the strip in contact with the upper surfaces of the rollers 32 and the lower surfaces of the rollers 32a the contact time can be varied even under the same running speed thus varying the cooling speed and the temperature of the cooled strip, so as to send the strip to the next step while maintaining it at a definite temperature. This cooling unit can be used at any point of travel of the strip, for example, the gas cooling zone 15 and the water cooling unit 17.

The cooling unit shown in FIGS. 2 and 3 can also be used as a cooling unit which can be switched to a direct cooling depending upon characteristic of steel strip to be cooled. Steel strips not requiring an over aging treatment can be cooled at such high cooling speed as 1000°-2000° C./sec. where oxide films are properly removed. Especially, in a high tension steel plate or strip in which a mixed structure of ferrite and martensite is obtainable with only a small quantity of special elements such high speed cooling by direct contact is advantageous. Accordingly, the cooling unit according to this invention can be also constructed to be switchable between indirect cooling using cooled rollers and direct cooling using water.

Figure 4:
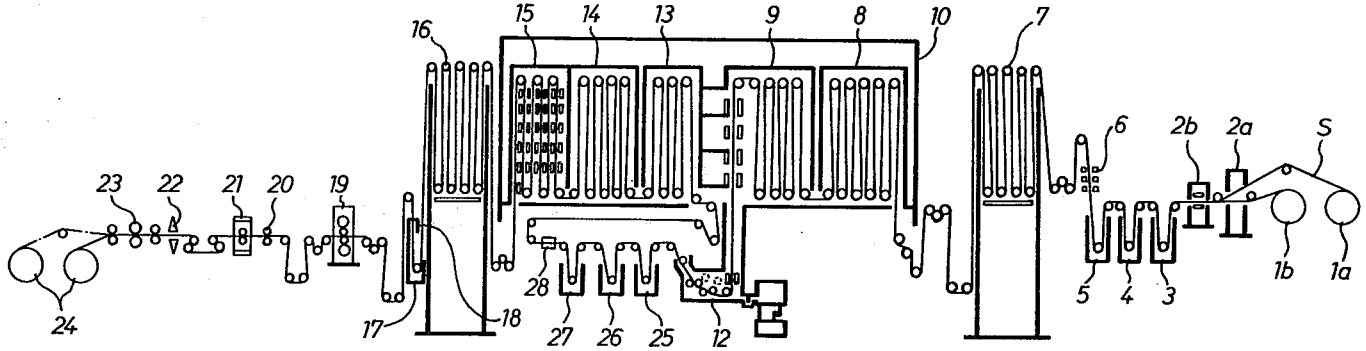
FIG. 4 is a diagrammatic representation showing another example of a continuous annealing apparatus according to this invention.
Figure 5:
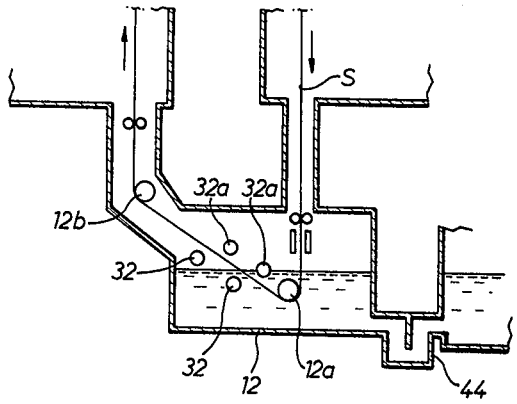
FIG. 5 is an enlarged side view of the cooling unit shown in FIG. 4 when it is used as a direct water cooling unit.
Figure 6:
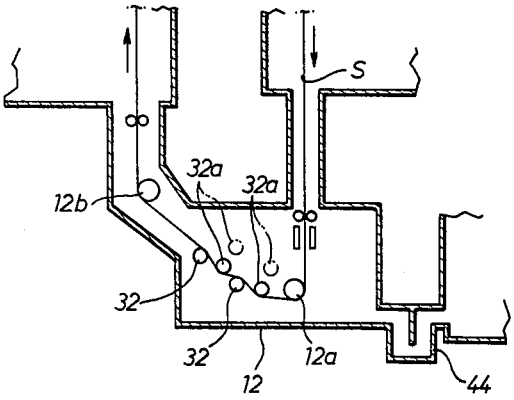
FIG. 6 is a side view similar to FIG. 5 showing a manner of cooling the cooling rollers by water passing therethrough.
Figure 8:
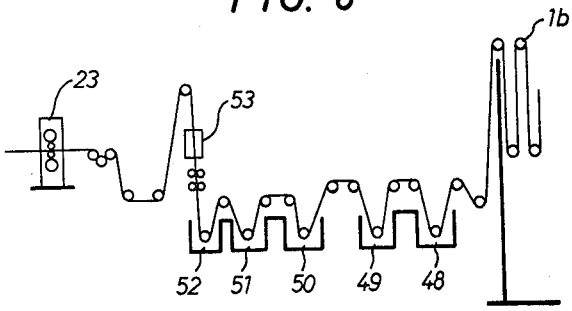
FIG. 8 is a partial view showing a modified apparatus shown in FIG. 4.

FIG. 4 shows a modified continuous annealing apparatus including the switchable type of cooling unit which is also shown in FIGS. 5 and 6. More particularly, the strip (S) is passed between four rollers 32 and 32a, of which the upper rollers 32a are moved in the vertical direction by a screw or oil pressure cylinder mechanism. Thus, when the upper rollers 32a are raised as shown in FIG. 5, the strip (S) passes directly between guide rollers 12a and 12b without contacting the cooling rollers 32 and 32a, whereas when the upper rollers 32a are lowered as shown in FIG. 6, the strip (S) passes alternately about rollers 32 and 32a. The contact area of the strip against the rollers can be adjusted depending upon the degree of lowering the upper rollers 32a. Accordingly, in the state shown in FIG. 6, the cooling speed and the final cooling temperature can be adjusted as desired by raising and lowering the upper rollers 32a.

Where the switchable cooling unit 12 shown in FIG. 4 is used as direct water cooling in the manner shown in FIG. 5, it is necessary to remove oxide film deposited on the strip during water cooling. For this purpose, a means for removing oxide film is provided between the cooling unit 12 and the reheating zone 13 as shown in FIG. 4. Thus, the strip cooled in the cooling unit 12 is passed through a pickling tank 25, a warm water washing tank 26, a neutralizing tank 27 and a dryer 28. Alternatively, as shown in FIG. 8, the oxide film removing means may be installed between the outlet looper 16 and the refining mill 19, said means comprising a pickling tank 48, a warm water washing tank 49, a neutralizing tank 50, another warm water washing tank 51, a water washing tank 52 and a dryer 53. On the other hand, where the cooling unit is used as indirect cooling using rollers as shown in FIG. 6 oxide film is not formed so that it is not necessary to use the pickling tank, the warm water washing tank and the neutralizing tank. Even in this case, only the water washing tank 52 and the dryer 53 are to be used.

Figure 7:
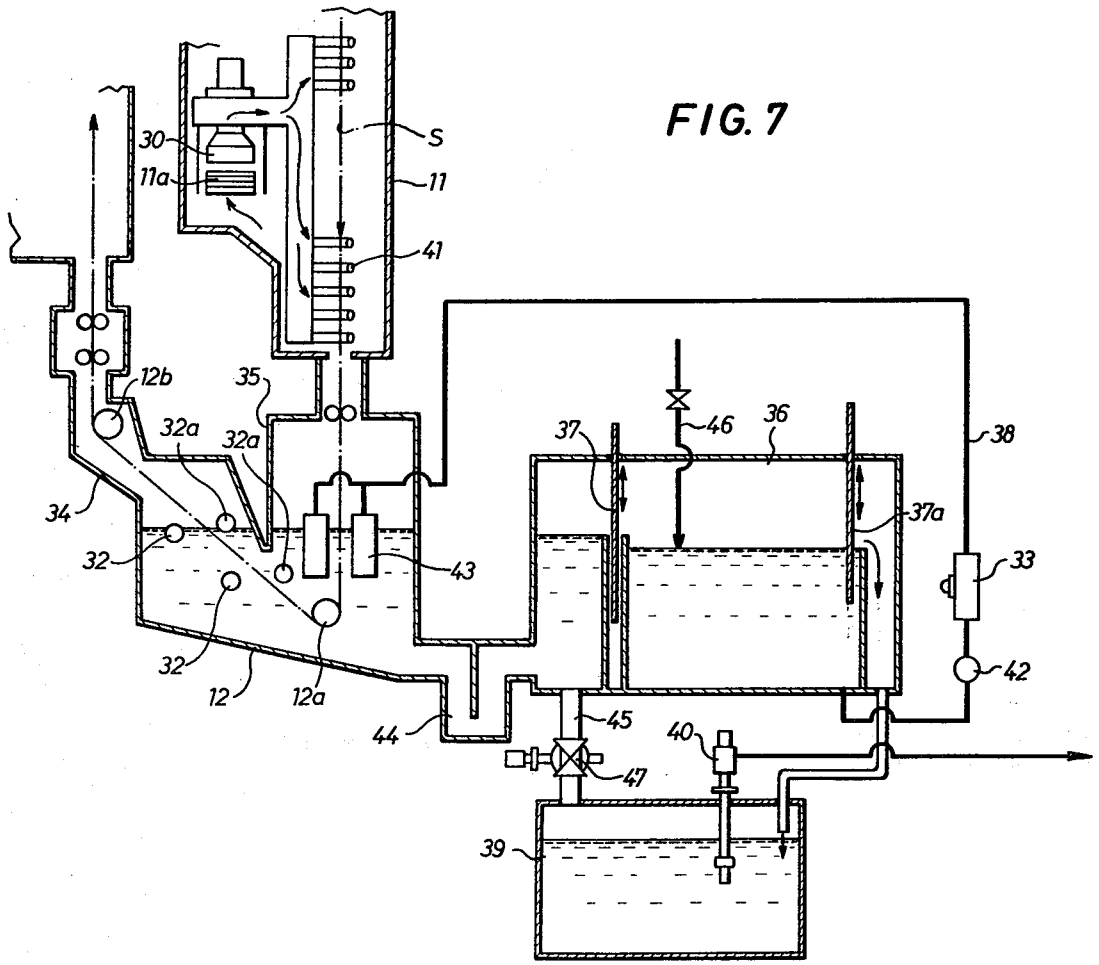
FIG. 7 is a diagrammatic longitudinal sectional view showing one example of the cooling unit together with a gas cooling unit.

As shown in FIG. 7 a gas jet cooling unit 11 may be added to the cooling unit 12 described above. The gas jet cooling unit 11 comprises a motor driven blower 60 and a plurality of gas ejection nozzles 41 which eject cooling gas sent from the blower 60 against the strip. The cooling gas is circulated in the unit 11 and cooled by water tubes 11a in front of the blower 30 down to a temperature of from 50°-150° C. from a temperature of 150°-250° C. As above described, operating state of the cooling unit 12 is switched between those shown in FIGS. 5 and 6. On the right hand side of a cooling chamber 35 is provided a circulating tank 36 supplemented with fresh water from a water supply pipe 46 when desired. On both sides of the water circulating tank 36 are provided water level adjusting gates 37 and 37a to adjust the water levels in the cooling chamber 35 and the tank 36. A strip exit port 34 is formed on the left hand side of the cooling chamber 35 to guide the strip to the pickling tank 17 or directly to the reheating zone 13. The water in the tank 36 is conveyed to water nozzles 43 via a conduit 38 including a filter 33 and a pump 42 to eject cooling water against the opposite surfaces of the strips (S).

A warm water reservoir 39 is located beneath the tank 36 for receiving warm water to the left of the gate 37 and water overflown from the gate 37a. The warm water collected in the reservoir 39 is discharged through a pump 40. The reservoir 39 is connected to the tank 36 through a pipe 45 and a valve 47.

In operation, the water level in the cooling chamber 35 is adjusted by the gate 37 while the strip is precooled by the gas blasted thereon through a plurality of nozzles 41 (for example 10 or more) and then cooled by the water in the cooling chamber 35. The water therein also acts as a sealing water for succeeding processing line. The warm water discharged by the pump 40 may be used in the hot water washing tank. When valve 47 is opened the water in the cooling chamber 35 to the left of the gate 37 is completely discharged into the reservoir 39 and the strip is cooled in a state shown in FIG. 6 by cooling rollers 32 and 32a. At this time, cooling water is passed through the interior of these rollers.

Accordingly, the switching of the cooling states between FIGS. 5 and 6 can be readily accomplished without discharging entire water of a large tank 36 but by merely discharging a relatively small quantity of the cooling water to the left of the gate 37. Even when the water to the left of the gate 37 is discharged the cooling gas in the gas jet cooling unit 11 is prevented from discharging to the outside by a water seal 44 disposed between the cooling chamber 35 and the tank 36.

As a consequence, with the construction shown in FIGS. 4–7 it is possible to cool the strip very quickly with water to a low temperature near room temperature or relatively slowly with water cooled rollers which do not form oxide films on the strip at the time of cooling, thus smoothly effecting a series of processings including over aging processing so as to produce various types of steel strips or plates suitable for different applications.

The indirect cooling will now be described in more detail. The temperature of the steel strip supplied to the cooling unit 12 through the heating zone 8 for the recrystallization annealing and the uniform heating zone 9 varies slightly, generally 500°–800° C., depending upon the thickness and the composition, and the strip is cooled by cooling rollers 32 and 32*a*. The cooling water flowing through these cooling rollers may be at room temperature, and variation in the temperature of the cooling water ranging from 5° C. to 30° C. does not cause any appreciable change in the cooling effect. Accordingly, even when the strip is cooled by 1° C. or heated by 60°–70° C., such cooling and heating do not affect the cooling effect of the cooling rollers. When the cooling rollers through which cooling water is passed are contacted to the steel strip, and when a steel strip having a thickness of 0.6 mm and heated to 300°–600° C., for example, is contacted against the cooling rollers for about one second the strip would be cooled by about 180° C., whereas when contacted for 2 seconds the strip would be cooled by about 260° C. When a steel strip having a thickness of 1.2 mm is contacted for one second it would be cooled to about 90° C., whereas about 140° C. when contacted for 2 seconds. Where a steel strip having a thickness of 0.8 mm running at a speed of 150 m/min. is contacted against water passed rollers 32 and 32*a* at a contact angle of $0.8\pi$ after being heated to 580° C. by the recrystallization annealing treatment is cooled to about 505°–515° C. by the first roller 32 and to about 465°–480° C. by the second roller 32*a*. The strip is cooled to 410°–420° C. by the third roller 32 and then to 380° C. by the fourth roller 32*a*. The same result can be attained by reducing the contact angle as the roller diameter is reduced. Even when strip gauge or line speed varies similar result can be obtained with a conact time of less than 2 sec. by varying other parameters. The strip thus cooled to 350°–380° C. is guided into the following heat treatment zone (13–15). Accordingly, fuel cost necessary for reheating the strip can be reduced at 25–30% in comparison with that in a case wherein strip is cooled to about room temperature.

To have better understanding of the invention the following examples are described.

EXAMPLE

A low carbon steel strip having a thickness of 0.8 mm, and a width of 1000 mm was passed through the heating zone 8 and the uniform heating zone 9 at a speed of 150 m/min. to effect recrystallization annealing for 1 min. and at a temperature of 700° C. and then supplied to the cooling unit 12 shown in FIG. 1. Each one of the cooling rollers 32 and 32*a* had a diameter of 600 mm and cooling water at 15° C. was passed through these rollers at a rate of 250 l/minute, and the strip (S) was cooled by contacting it about these cooling rollers at a contact angle of from 0° to $0.9\pi$. The temperature of the strip (S) was about 600° C. when it enters into the cooling unit and cooled to about 395° C. to 415° C. and the variation in the temperature of the cooled strip was less than 20° C. which means uniform cooling. Thus cooled strip is then over aged at a temperature of 400°–350° C. for 3 min. in the reheating zone 13 and the over aging proceeding zone 14 thereby obtaining strip of steel having uniform mechanical properties which is suitable for use in contraction.

What we claim:

1. In an apparatus for carrying out a continuous annealing treatment on a steel strip, a cooling unit for cooling a steel strip which has been heated to a temperature above a recrystallization point in the continuous annealing treatment, comprising:

a cooling chamber (12) for receiving said heated steel strip;

a plurality of cooling rollers (32, 32*a*) in said cooling chamber and about which said steel strip is adapted to be passed so that said steel strip contacts said cooling rollers over a given contact area so as to be cooled thereby; and elevating means (30) for selectively raising and lowering some of said plurality of cooling rollers with respect to remaining cooling rollers for selectively changing a contact angle and the contact area between said steel strip and said cooling rollers and for selectively releasing the contact between said steel strip and said cooling rollers, to thereby vary the cooling rate of said steel strip;

said cooling chamber further comprising means for water-quenching said steel strip when the contact between said steel strip and said rollers is released.

2. The cooling unit of claim 1, wherein said water-quenching means comprises a water nozzle (43) for spraying water against said steel strip.

3. The cooling unit of claim 1, wherein said cooling chamber comprises reservoir means which is filled with water for water-quenching said steel strip.

4. The cooling unit of claim 1, further comprising a water tank (36) connected to said cooling chamber through a water-seal chamber (44).

5. The cooling unit of claim 1, further comprising gas-cooling means (41) for cooling said steel strip with cooling gas before it enters said cooling chamber.

6. The cooling unit of claim 5, wherein said gas-cooling means comprises a plurality of nozzles for ejecting cooled gas against said steel strip, a blower for circulating said gas through said nozzle and a water cooler for cooling the circulating gas.

7. The cooling apparatus of claim 1, wherein said plurality of cooling rollers are arranged such that said steel strip passes alternately about upper and lower surfaces of said cooling rollers.

8. The cooling unit of claim 1, wherein said steel strip is drawn in a given direction, and said plurality of cooling rollers are arranged adjacent each other in the direction of drawing of said steel strip, and said elevating means includes means for selectively raising and lowering alternate cooling rollers relative to the remaining cooling rollers to vary the contact angle, and thereby the contact area of said steel strip relative to said cooling rollers.

* * * * *